US011495076B2

(12) United States Patent
Cohrs

(10) Patent No.: US 11,495,076 B2
(45) Date of Patent: Nov. 8, 2022

(54) COIN STORAGE UNIT

(71) Applicant: Crane Payment Innovations Ltd., Oldham (GB)

(72) Inventor: Sebastian Cohrs, Horneburg (DE)

(73) Assignee: Crane Payment Innovations Ltd., Oldham (GB)

( * ) Notice: Subject to any disclaimer, the term of this patent is extended or adjusted under 35 U.S.C. 154(b) by 0 days.

(21) Appl. No.: 16/982,470

(22) PCT Filed: Mar. 15, 2019

(86) PCT No.: PCT/EP2019/056615
§ 371 (c)(1),
(2) Date: Sep. 18, 2020

(87) PCT Pub. No.: WO2019/179900
PCT Pub. Date: Sep. 26, 2019

(65) Prior Publication Data

US 2021/0082223 A1 Mar. 18, 2021

(30) Foreign Application Priority Data

Mar. 19, 2018 (EP) ..... 18162650

(51) Int. Cl.
*G07D 1/00* (2006.01)
*G07D 3/00* (2006.01)

(52) U.S. Cl.
CPC ..... *G07D 1/00* (2013.01); *G07D 3/00* (2013.01); *G07D 2201/00* (2013.01)

(58) Field of Classification Search
CPC ..... G07D 1/00; G07D 3/00; G07D 2201/00
See application file for complete search history.

(56) References Cited

U.S. PATENT DOCUMENTS 4,221,227 A * 9/1980 Heiman ..... G07D 1/00 453/9
4,250,905 A * 2/1981 Kobayashi ..... G07D 1/00 221/125

(Continued)

FOREIGN PATENT DOCUMENTS

CN 101228560 A 7/2008
EP 0924660 A2 6/1999

(Continued)

OTHER PUBLICATIONS

International Search Report dated Apr. 4, 2019 in connection with International Patent Application No. PCT/EP2019/056615, 2 pages.

(Continued)

*Primary Examiner* — Thien M Le
*Assistant Examiner* — Asifa Habib

(57) ABSTRACT

The invention relates to a coin storage unit comprising a housing and multiple coin tubes arranged interchangeably in the housing, wherein locking means are provided for the coin tubes, which are actuatable between a locking position locking the coin tubes against removal from the housing and an unlocking position releasing the coin tubes for removal from the housing, wherein the locking means are arranged between each two adjacent coin tubes in the housing and lock the adjacent coin tubes against removal from the housing in the locking position, and wherein the locking means can only assume the locking position in the state of the adjacent coin tubes inserted completely into the housing.

18 Claims, 7 Drawing Sheets

(56) References Cited

U.S. PATENT DOCUMENTS

| | | | | |
|---|---|---|---|---|
| 4,367,760 | A * | 1/1983 | Thomas | G07D 1/00 453/41 |
| 5,400,891 | A * | 3/1995 | Winstanley | G07D 1/00 194/350 |
| 5,944,601 | A | 8/1999 | Hayashi et al. | |
| 2004/0097181 | A1* | 5/2004 | Perkitny | G07D 3/06 453/3 |
| 2011/0076930 | A1* | 3/2011 | Chang | G07D 1/00 453/18 |
| 2012/0309280 | A1 | 12/2012 | Chang | |

FOREIGN PATENT DOCUMENTS

| | | | |
|---|---|---|---|
| TW | M370786 | U | 12/2009 |
| TW | 201537522 | A | 10/2015 |

OTHER PUBLICATIONS

Written Opinion of the International Searching Authority dated Apr. 4, 2019 in connection with International Patent Application No. PCT/EP2019/056615, 5 pages.

Examination Report dated Jan. 11, 2022, in connection with Taiwanese Application No. 108106746, 18 pages.

* cited by examiner

COIN STORAGE UNIT

CROSS-REFERENCE TO RELATED APPLICATIONS

This application is a 371 National Stage of International Application No. PCT/EP2019/056615 filed on Mar. 15, 2019, which claims the benefit of European Patent Application No. 18162650.8 filed on Mar. 19, 2018, the disclosures of which are herein incorporated by reference in their entirety.

TECHNICAL FIELD

The invention relates to a coin storage unit comprising a housing and multiple coin tubes arranged interchangeably in the housing.

BACKGROUND

Coin tubes, which are generally hollow and cylindrical, each accommodate coins of a specific diameter stacked one on top of another. Known coin storage units have, for example, six coin tubes arranged along a U shape or in another manner in a housing of the coin storage unit. The coin storage units are used, for example, in money changers, which can in turn be used in vending machines, such as ticket machines or slot machines or the like. They have a payout module, using coins which can be paid out of the coin tubes. In addition, they have a coin slot, a coin validator, and a coin sorting device, using inserted coins which can be assigned to the respective coin tubes. In addition, a coin return channel for returning counterfeit coins and a cash register channel for accepting coins outside the coin tubes, for example, if the coin tubes are full, are regularly provided.

It is sometimes desirable for users to be able to remove the coin tubes themselves from the housing and replace them with other coin tubes, for example, for adaptation to the frequency of specific coin types. Coin storage units having interchangeable coin tubes are known, for example, from U.S. Pat. No. 5,400,891 A or U.S. Pat. No. 5,944,601 A. In the coin storage unit described in U.S. Pat. No. 5,400,891 A, the coin tubes are held in the housing by a press fit. This can make installation difficult. In addition, there is a desire for a reliable locking of the coin tubes in the assembled position and checking of the locking. In the coin storage unit described in U.S. Pat. No. 5,944,601, the tubes lock together and are inserted as a whole into a housing of a money changer. This coin storage unit is complex to install and does not offer a secure and reliably checkable locking. The flexibility with regard to the arrangement of different coin tubes is limited. Further coin storage units are known, for example, from U.S. Pat. Nos. 4,221,227 A, 4,250,905 A, 5,011,456 A, 8,262,441 A, and US 2017/345242 A1.

Coin storage units described in the prior art often only allow coin tubes to be exchanged with the aid of tools. This requires specially trained personnel and makes the exchange of coin tubes complex. Furthermore, there is often no reliable monitoring of the correct positioning and locking of the coin tubes. Finally, the flexibility with respect to the arrangement of coin tubes of large diameter in particular is restricted in the prior art. The dimensions of the outer housings of money changers are thus standardized and accordingly cannot be changed without massive restrictions on the usability in standard vending machines. This therefore also limits the housing dimensions of coin storage units accordingly. For example, with an arrangement of six coin tubes positioned along a U shape, large-diameter coin tubes abut one another and inner surfaces of the housing. Locking methods for the coin tubes described in the prior art regularly cannot be used with such large coin tubes.

SUMMARY

Proceeding from the prior art explained, the invention is based on the object of providing a coin storage unit of the type mentioned at the outset, which simple and reliably checkable proper installation of the coin tubes is ensured with the greatest possible flexibility with regard to the size and arrangement of the coin tubes.

The invention achieves the object by way of the subject matter of claim 1. Advantageous designs can be found in the dependent claims, the description, and the figures.

For a coin storage unit of the type mentioned at the outset, the invention achieves the object in that locking means are provided for the coin tubes, which are actuatable between a locking position locking the coin tubes against removal from the housing and an unlocking position releasing the coin tubes for removal from the housing, wherein the locking means are arranged between each two adjacent coin tubes in the housing and lock the adjacent coin tubes against removal from the housing in the locking position, and in that the locking means can only assume the locking position in the state of the adjacent coin tubes inserted completely into the housing.

According to one preferred design, the locking means can be provided on the housing. The coin storage unit forms a storage cassette. It can be used, for example, in money changers of vending machines, such as ticket machines, slot machines, or the like. The money changer has a main housing, the dimensions of which are standardized. The coin storage unit forms a module that can be inserted preassembled as a whole into and removed from the main housing of a money changer. The available installation space for the coin storage unit thus results from the dimensions of the main housing minus the space requirement of other modules of the money changer, for example, the payout module or the coin sorting unit. In terms of a large capacity of the coin storage unit, the structural height of the remaining modules is therefore kept as small as possible and the installation space of the coin storage unit is utilized in the best possible manner, for example, by skilled arrangement and diameter selection of the coin tubes. The coin storage unit can comprise, for example, six coin tubes arranged in the housing along a U shape. The coin tubes are each hollow cylindrical having open end faces and accommodate coins of a specific diameter stacked one on top of another in the form of coin columns. A different tube internal diameter is provided depending on the coin diameter. The external diameter of the coin tubes is generally approximately 3 mm larger than the internal diameter.

The housing can have a frame section and a base section. These can be integrally connected to one another or can be separate sections from one another which are detachably connectable to one another, for example. The detachable connection can be produced, for example, by screwing or latching. For example, the frame section can comprise the locking means according to the invention for locking the coin tubes. For example, the frame section can comprise a base section and a wall section for holding the coin tubes. For example, the base section can be used for the radial positioning of the coin tubes and as a support surface for the coin columns held in the coin tubes open at the bottom. In addition, a handle (latch) can be provided for holding the coin storage unit on the housing. The coin storage unit can be inserted into and removed from the main housing of a money changer via this handle. Furthermore, the handle, which is spring-loaded in particular, can be used for locking the inserted coin storage unit in its lower end position. The housing can have a front cover, which can cover, for example, a coin return channel. The front cover can also cover, for example, the locking means of two adjacent coin tubes, for example, the coin tubes arranged on the base side of a U shape. The front cover can be detachably connectable to the other housing part or the other housing parts, for example, via latching.

For installation, the coin tubes are inserted into the housing from above at the desired position. They can assume their final installation position due to gravity. According to the invention, locking means are provided which are actuatable, in particular movable, between a locking position and an unlocking position. In the locked position, the coin tubes are secured against axial withdrawal from the housing. In the unlocking position, however, the coin tubes can be removed from the housing in the axial direction, for example, for exchange with other coin tubes. The axial position of the coin tubes inserted completely into the housing is reliably defined and is checkable in a simple manner by the locking position of the locking means. This is achieved in that the locking means can only assume their locking position when the coin tubes are completely inserted into the housing. This essentially play-free axial arrangement of the coin tubes is of crucial importance for the reliable dispensing of coins by a payout module. The manual actuation of the locking means, which is possible according to the invention, enables simple and quick, tool-free exchange of the coin tubes arranged in the housing.

In addition, the locking means are each arranged according to the invention (in particular centrally) between two adjacent coin tubes. The free space formed between the adjacent tubes in cylindrical coin tubes is thus used for locking. In the case of adjacent coin tubes which essentially abut one another, this free space is delimited between the cylindrical outer surfaces of the coin tubes and, for example, a housing wall delimiting the arrangement of the coin tubes from the outside. By using this intermediate space for locking, adjacent coin tubes can be arranged, on the one hand, essentially abutting one another. At the same time, the external diameter of the coin tubes can extend up to the inner surface of a housing wall delimiting the housing. As a result, larger coin tubes can be accommodated with the same external dimensions of the housing as in the prior art, with a secure and defined locking at the same time. This in turn gives the coin storage unit according to the invention the greatest possible flexibility. For example, according to the invention, it is possible to arrange coin tubes having internal diameters of up to 33 mm (external diameters of up to 36 mm) in the housing. In the prior art, insufficient space is available for locking between the inner surface of the housing and the coin tube region of the largest diameter with such coin tubes and with dimensions of the housing restricted due to the standardized dimensions of the money changer. According to the invention, two adjacent coin tubes can be securely locked with only one locking means in an easy-to-install manner, which also enables a quick tube exchange without tools. The coin storage unit according to the invention thus permits the combination of the large coin capacity of a six-tube coin storage unit with the greatest possible combinability of the tube diameters, which ensures optimum coverage of the market-relevant coin diameter spectrum, and simple exchange of the coin tubes with reliable and checkable locking in the properly installed position at the same time.

According to one design, the locking means can each be arranged and formed symmetrically with respect to adjacent coin tubes. This further simplifies the interchangeability of the coin tubes. A geometry of the coin tubes interacting with the locking means, for example guide projections or the like, can correspondingly be formed symmetrically.

According to one design, the locking means can comprise at least one pivotable locking lever that is pivotable on the housing between the locking position and the unlocking position. In particular, multiple locking levers can be provided. A locking lever locks two adjacent coin tubes. Thus, n/2 locking levers can be provided, wherein n is the number of the coin tubes in the housing. For example, with six coin tubes, three locking levers can be provided on the housing. The at least one locking lever is held captively on the housing. It can have a T-shaped locking section. The roof section of the T-shape can then lie on corresponding locking projections of two adjacent coin tubes and thus secure the coin tubes against axial withdrawal from the housing.

According to a further design, the at least one locking lever can lock in the locking position on latching surfaces of the housing, for example a frame section of the housing, and thus lock the adjacent coin tubes against removal from the housing. Particularly secure locking is thus produced. At the same time, the at least one locking lever for exchanging coin tubes is releasable in a simple manner and without tools.

According to a further design, the coin tubes can each comprise at least one locking projection on their outer circumference, wherein the at least one locking lever rests in the locking position on locking projections of adjacent coin tubes. The at least one locking lever secures adjacent coin tubes against axial release from the housing by this resting on the locking projections. In particular if multiple locking levers are provided, they accordingly each rest on the locking projections of adjacent coin tubes.

The at least one locking lever can be pivotably mounted on the housing by means of a latching connection. A particularly simple initial installation of the at least one locking lever on the housing is hereby achieved. After the initial installation, it can remain permanently arranged on the housing.

According to a further design, the at least one locking lever can only terminate flush with a surface of the housing surrounding the locking lever in the locking position. The locking lever thus does not protrude beyond the housing (only) in the locking position. On the one hand, this enables a particularly reliable optical and haptic checking of the correct locking. In addition, for example, lateral outer walls of the housing, in the case of a U-shaped arrangement of the coin tubes, that is to say lateral outer walls arranged on the legs of the U shape, generally lie flush against the inner walls of a main housing accommodating the coin storage unit, for example, of a money changer. It is ensured by the above-mentioned design that installation of the coin storage unit in the money changer is only possible with properly locked coin tubes. This also applies, for example, to a housing surface of a base side of a U-shaped arrangement of coin tubes, if a front cover of the housing is also installed on this base side. This can be designed in such a way that it in turn rests flush against the underlying housing surface, which surrounds the locking lever, so that the front cover can again only be attached if the coin tubes are correctly locked. A particularly high level of installation security is thus achieved.

According to a further design, guide means can be provided for guiding the coin tubes in the radial direction. The guide means provide lateral guidance of the coin tubes as they are inserted into the housing. In addition, they secure the coin tubes in the radial direction in their position inserted into the housing. It is therefore sufficient if the locking means only provide securing of the guide tubes against withdrawal in the axial direction. Lateral release from their respective position can be prevented by the guide means. A particularly simplified installation and positioning is achieved by the guide means.

The guide means can comprise guide projections on the coin tubes and guide webs on the housing corresponding to the guide projections. The guide projections slide in the guide webs, so that particularly reliable guidance is ensured during the installation. In the interlocking state of the guide projections and guide webs, in particular a safeguard against radial movement of the coin tubes is achieved. For this purpose, at least some guide projections can have guide grooves that interact with the guide webs. The guide projections can have stop faces with which they strike in the position fully inserted into the housing on corresponding support surfaces of the housing. As a result, the end position of the coin tubes completely inserted into the housing is reliably defined.

According to a further design, the coin tubes can each have an upper guide projection in the region of their upper end and a lower guide projection in the region of their lower end. Corresponding upper and lower guide webs can be formed on the housing. A further improved guidance and thus a further simplified installation is thus implemented. At the same time, the lateral securing of the coin tubes in the installed state is further improved. During the insertion, firstly the lower guide projections of the coin tubes engage in the upper and/or lower guide webs of the housing. The upper guide projections then engage in the upper guide webs.

According to a particularly practical and easy-to-manufacture design, the upper guide projection can simultaneously form the locking projection.

The insertion of the coin tubes into the housing can be further facilitated if at least the lower guide webs have insertion bevels for the lower guide projections.

According to a further design, the guide means can further comprise centering pins and centering receptacles formed on the underside of the coin tubes and on an associated bottom side of the housing, wherein the centering pins and the centering receptacles interlock in the state of the coin tubes completely inserted into the housing. For example, two centering pins or two centering receptacles can be formed on the underside of the coin tubes. Two centering receptacles or two centering pins, respectively, are then correspondingly formed on the facing bottom side of the housing. The centering pins and the centering receptacles ensure the correct rotational position of the coin tubes and their fine centering in the housing. Centering pins and centering receptacles have corresponding geometries, for example, they are each cylindrical.

The coin tubes usable in the coin store according to the invention can have different internal diameters, preferably in the range from 17 mm to 33 mm, wherein the coin tubes can be arranged at different positions in the housing. The diameter range from 17 mm to 33 mm covers the common, market-relevant currencies. The fact that the coin tubes can be flexibly arranged in different positions and thus interchangeably in the housing provides the user with the greatest possible flexibility. This can be ensured in particular in that the radial distance between the guide projections and the tube center axis is the same for each coin tube. This applies in particular to the radial distance between the sections of the guide projections which participate in the guiding and locking. For example, a section with which the guide projections are attached to the outer surface of the coin tubes can have different lengths depending on the coin tube diameter. Reliable guiding and locking can be ensured for every coin diameter in every position in the housing by this design.

The invention also relates to a money changer comprising a main housing and a coin storage unit according to the invention inserted into the main housing. As already explained, the money changer can be used, for example, in vending machines, such as ticket machines or slot machines or the like. As also already explained, it has a payout module, using coins which can be paid out of the respective coin tubes. In addition, in a manner known per se, the money changer has a coin slot with subsequent coin validator and coin sorter, which sorts inserted coins into the respective coin tubes depending on their size. The money changer can additionally have a return channel for returning rejected coins. Furthermore, the money changer can have a cash register channel, which is used to feed accepted coins into a cash register. This cash register as part of the vending machine is used for the (unsorted) storage of coins, for example, with fully filled coin tubes.

BRIEF DESCRIPTION OF THE DRAWINGS

An exemplary embodiment of the invention is explained in greater detail hereafter on the basis of figures. In the schematic figures.

DETAILED DESCRIPTION

Unless otherwise stated, the same reference symbols denote the same objects in the figures.

Figure 1:
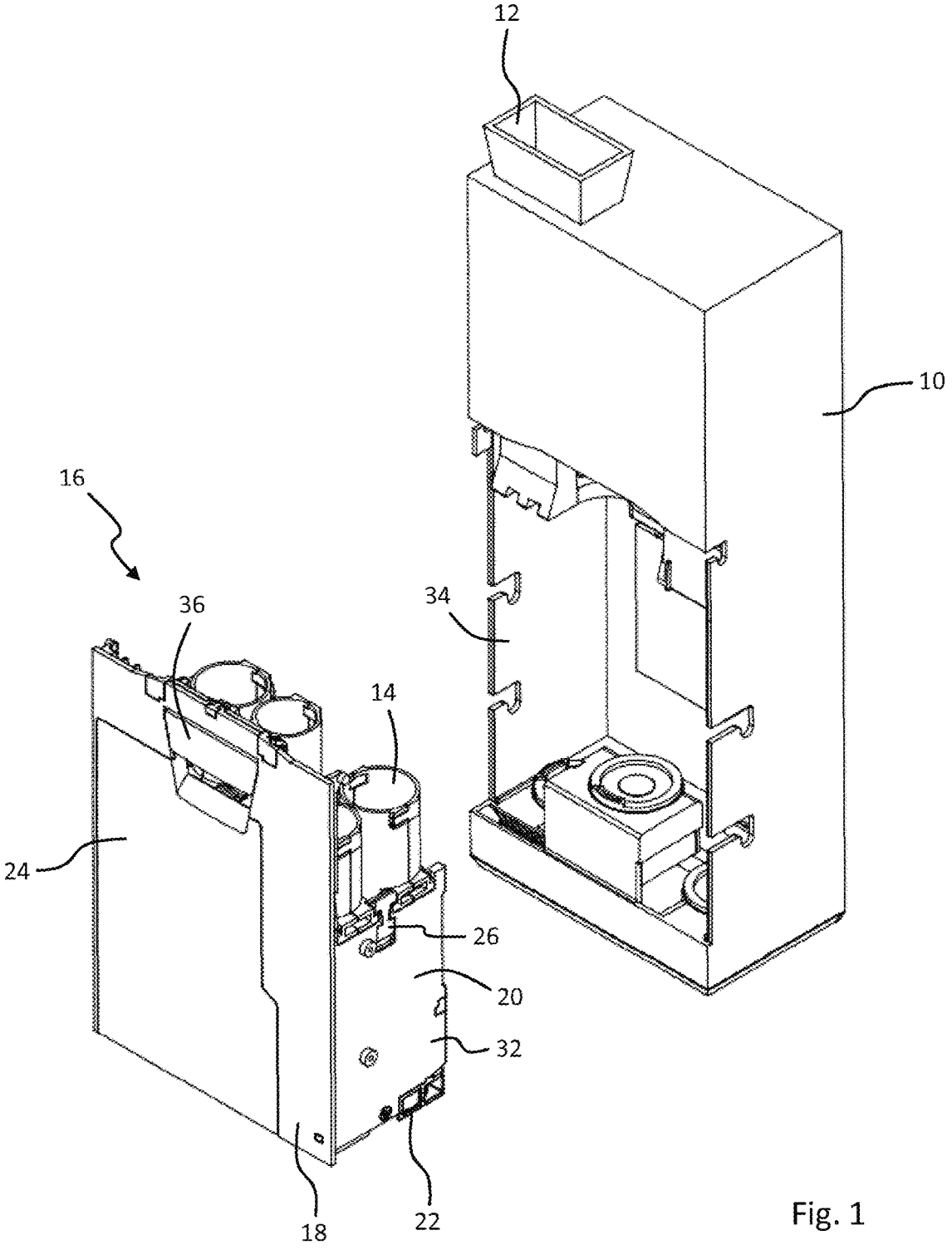
FIG. 1 shows a money changer according to the invention having a coin storage unit according to the invention in a partially disassembled state in a perspective view.
Figure 2:
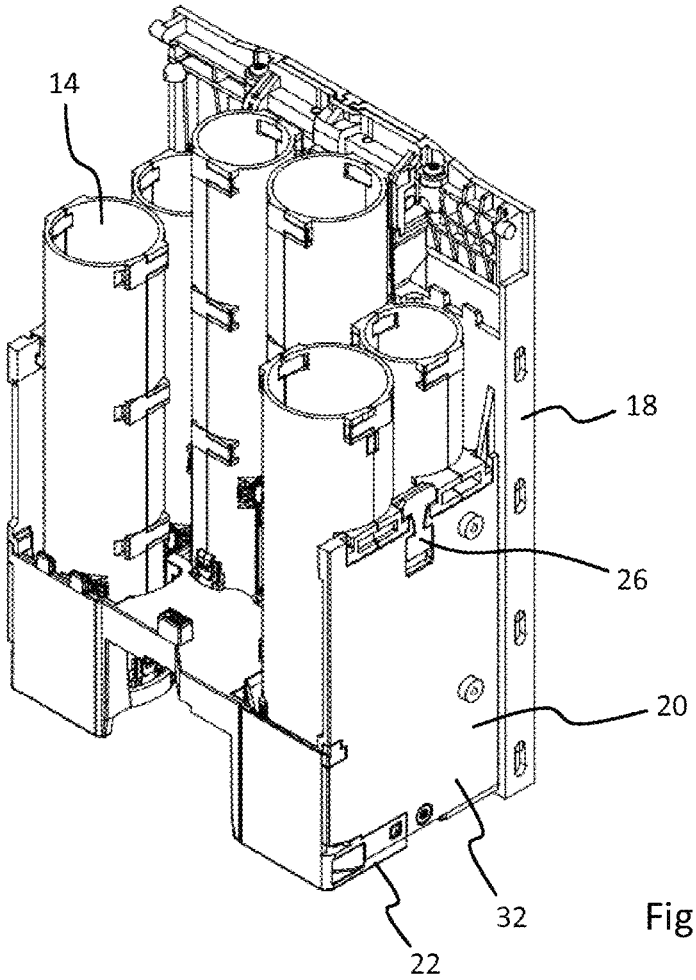
FIG. 2 shows the coin storage unit shown in FIG. 1 in a further perspective view.
Figure 3:
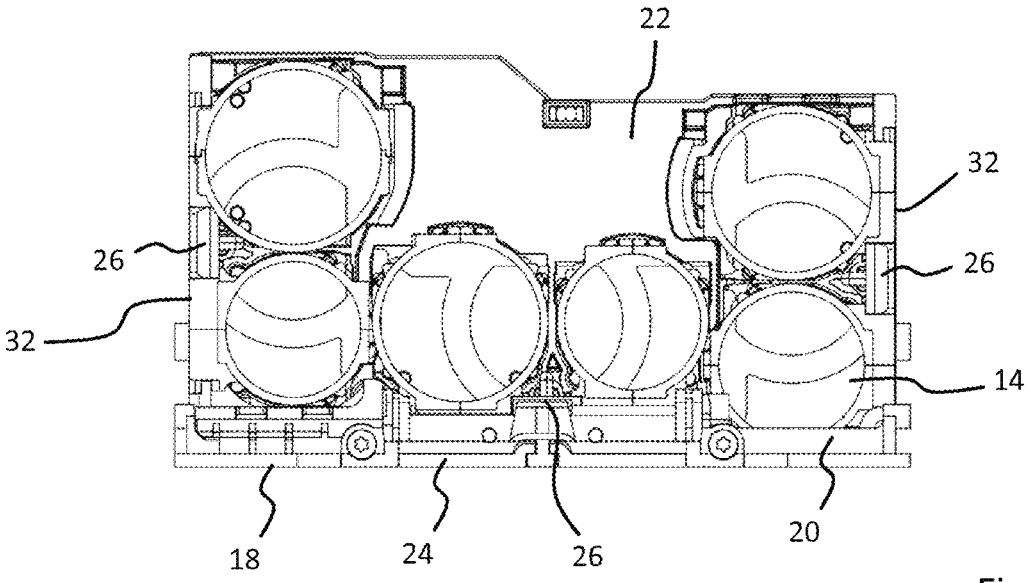
FIG. 3 shows the coin storage unit from FIG. 2 in a top view.

A money changer having a main housing 10 is shown in FIG. 1, which can be used, for example, in vending machines, such as ticket machines, slot machines, or the like. The money changer has a coin slot 12 and a coin validating unit, which is essentially concealed in FIG. 1 and has a subsequent coin sorting unit, which sorts the inserted coins depending on their denomination or diameter into the coin tubes 14 of the coin storage unit shown in FIG. 1 at the reference signs 16. A payout module (not shown in greater detail in FIG. 1) is used to pay out coins from the coin tubes 14 via a coin dispenser. In addition, the money changer has a coin return channel, via which rejected coins can be ejected, and a cash register channel, via which coins can be fed to a cash register. This structure and this function of a money changer are known per se.

The coin storage unit 16 has a housing 18 in which six coin tubes 14 arranged along a U-shape are arranged in the example shown. Coins are kept stacked one on top of another in the hollow cylindrical coin tubes 14. The housing 18 is inserted into the main housing 10 of the money changer and can be held in this, for example, by latching. Depending on the diameter, the coin tubes 14 can be arranged abutting one another and abutting inner surfaces of the housing 18. In the example shown, the housing 18 has a frame section 20 and a base section 22, which can be connected to one another, for example, by screwing. Furthermore, the housing 18 has a front cover 24 which can be fastened to the frame section 20, for example, by latching.

In addition, three locking levers 26 are provided in the example shown, which are each pivotably mounted in a lever receptacle 28 of the housing 18 by means of a latching connection, as will be explained in more detail below. It is apparent in particular in FIG. 4 that the lever receptacle 28 provided on the base side of the U shape of the coin tubes 14 and with it the corresponding locking lever 26 held therein are concealed in the installed state by the front cover 24. The inside of the front cover 24 is flush in this case with the housing surface 30 surrounding this lever receptacle 28. In addition, the lateral outer walls 32 of the housing 18, which have the two further lever receptacles 28, abut flush against the inner sides 34 of the main housing 10 facing toward them in the state installed in the main housing 10. A handle (latch) for carrying the coin storage unit and for locking the coin storage unit in its lower end position is apparent at reference number 36.

Figure 4:
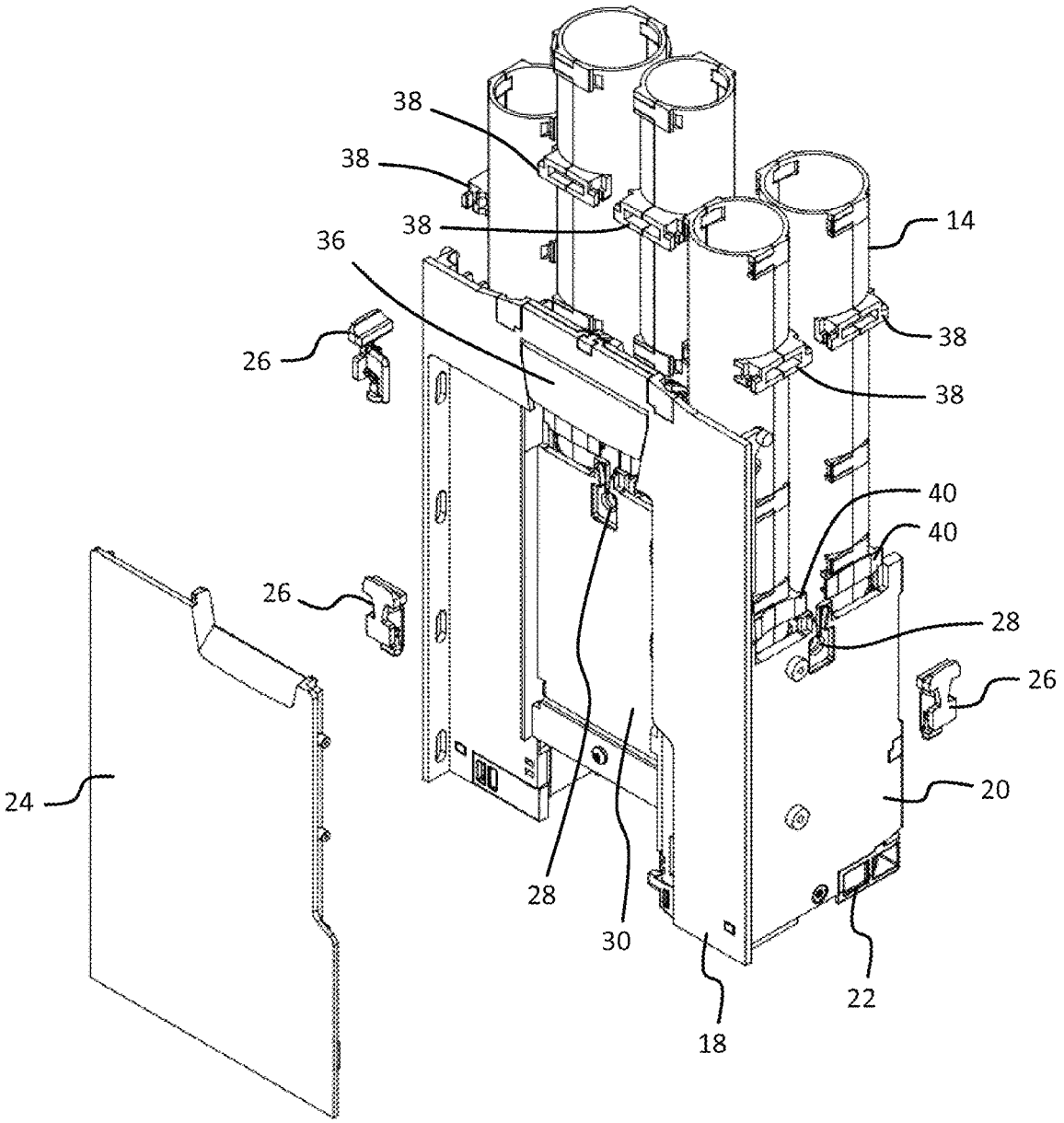
FIG. 4 shows the coin storage unit shown in FIG. 2 in a perspective partially exploded illustration.
Figure 5:
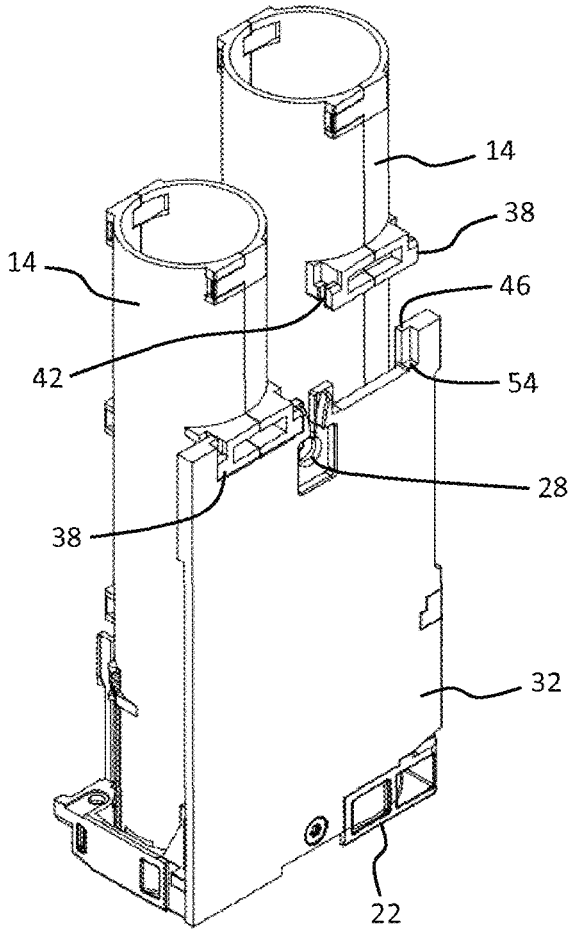
FIG. 5 shows a part of the coin storage unit shown in FIG. 2 in a perspective view.
Figure 6:
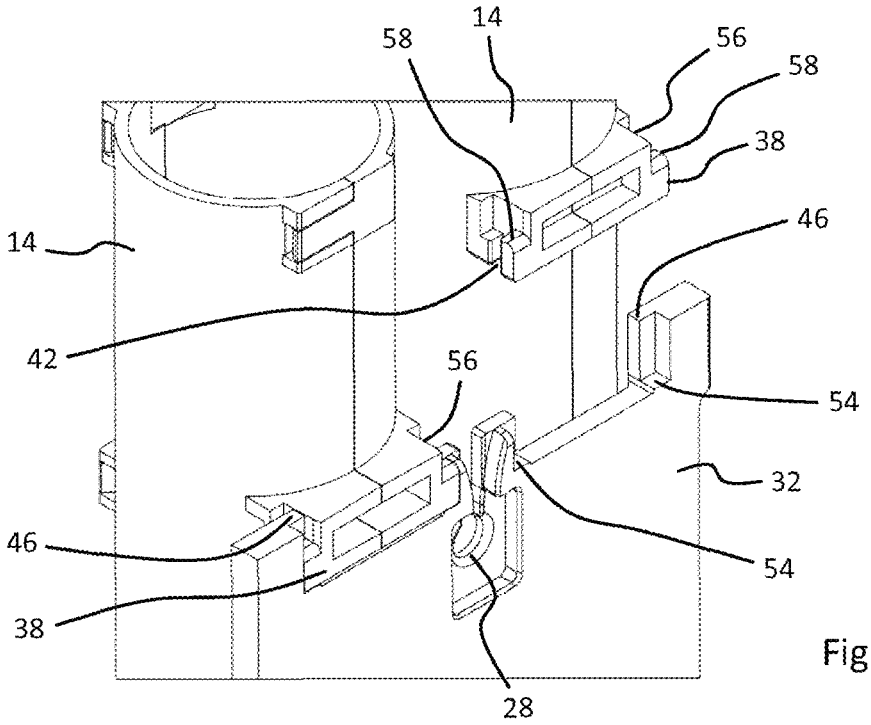
FIG. 6 shows an enlarged detail of the illustration of FIG. 5.
Figure 7:
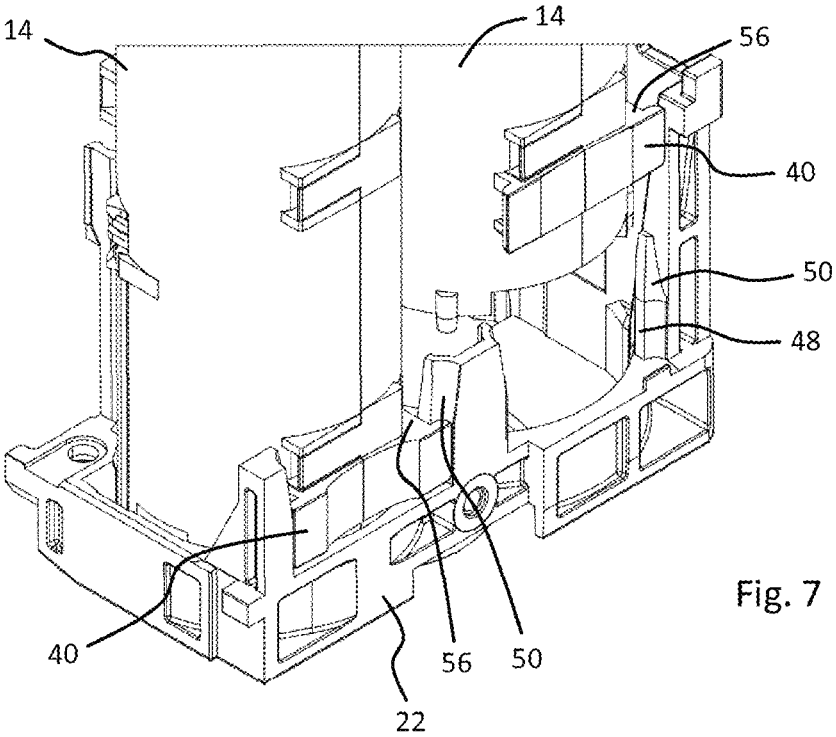
FIG. 7 shows a further enlarged detail of the illustration of FIG. 5 without a housing wall.
Figure 8:
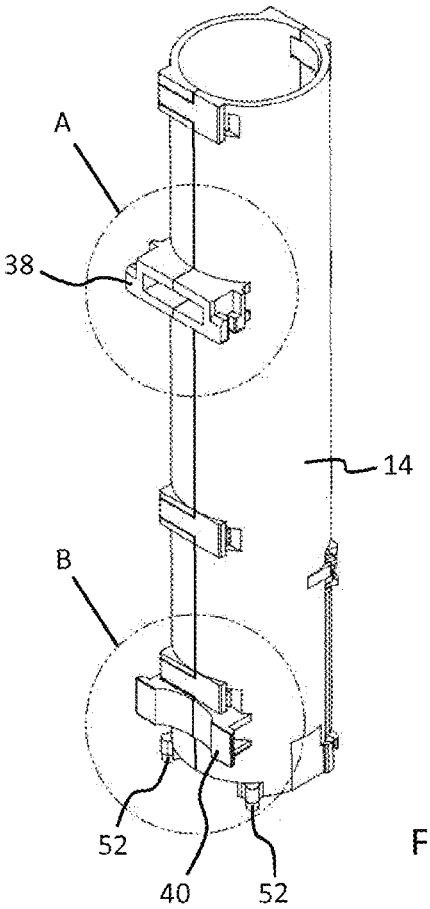
FIG. 8 shows a coin tube of the coin storage unit shown in FIG. 2 in a perspective view.
Figure 9:
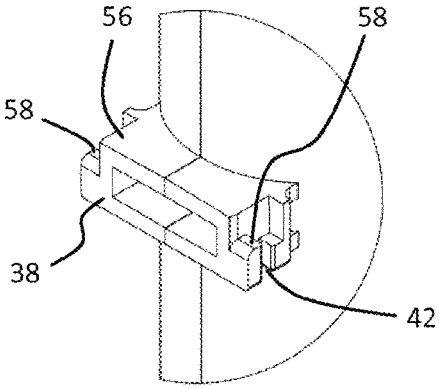
FIG. 9 shows detail A from FIG. 8 in an enlarged illustration.
Figure 10:
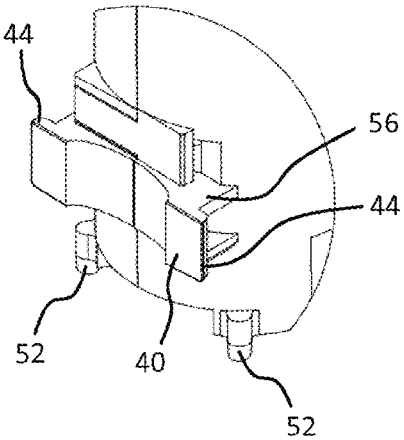
FIG. 10 shows detail B from FIG. 8 in an enlarged illustration.

Only a part of the coin storage unit is shown for illustration in FIG. 5, in particular the outer wall 32 also apparent in FIG. 4. The left one of the two coin tubes 14 in FIG. 5 is already in its position inserted completely into the housing 18 in the illustration of FIG. 5. The coin tube 14 on the right in FIG. 5, in contrast, is not yet in its position inserted completely into the housing 18. FIGS. 6 and 7 show enlarged details of the illustration from FIG. 5, wherein the housing wall forming the outer wall 32 in FIG. 5 is also not shown for reasons of illustration in FIG. 7. The coin tubes 14 each have an upper guide projection 38 and a lower guide projection 40. The upper guide projection 38 has a tube-side guide groove 42 on both sides. The lower guide projection 40 has a tube-side guide web 44 on both sides. Upper housing-side guide webs 46 corresponding to the tube-side guide grooves 42 of the upper guide projections 38 are provided on the housing 18. In addition, housing-side guide webs 48 corresponding to the tube-side guide webs 44 of the lower guide projections 40 are also formed on the base section 22 of the housing 18. The lower tube-side guide webs 44 are guided between these housing-side guide webs 48 and the respective adjacent inner surface of the outer wall 32. The lower housing-side guide webs 48 on the base section 22 of the housing 18 also have insertion bevels 50 which facilitate insertion of the tube-side guide webs 44 of the lower guide projections 40. In the example shown, two cylindrical centering pins 52 are furthermore formed on the underside of the coin tubes 14 and are accommodated in corresponding cylindrical centering receptacles in the state completely inserted into the housing. The undersides of the upper guide projections 38 form stop surfaces, which the coin tubes 14 strike on associated support surfaces 54 in the state completely inserted into the housing. As a result, the position of the coin tubes 14 completely inserted into the housing 18 is reliably defined. In addition, locking surfaces 58 are formed on both sides on the upper guide projections 38, the function of which will be explained in greater detail below.

It is apparent that, in the example shown, all coin tubes 14 have the described guide projections 38, 40, which interact in the assembled state with associated housing-side guide webs 46, 48 on the housing. The guide projections 38, 40 of the coin tubes 14 differ only in the case of different diameters of the coin tubes. The radial distance between the respective tube center axis and the guide projections 38, 40, in particular the sections participating in the guidance, is thus the same for each coin tube 14. For this purpose, a section 56 connecting the guide projections 38, 40 to the outer surface of the respective coin tube 14 has different lengths (see, for example, FIGS. 6, 7 and 9 and 10). This design ensures that the coin tubes 14 can be flexibly arranged interchangeably at the specified positions in the housing.

Figure 11:
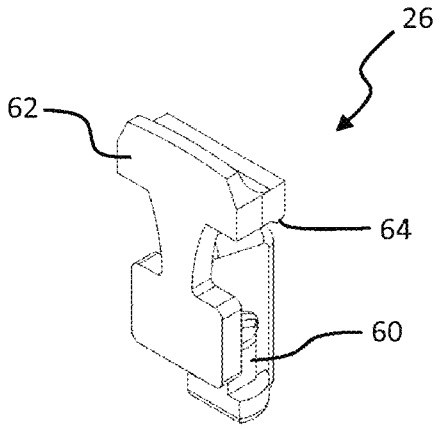
FIG. 11 shows a locking lever of the coin storage unit shown in FIG. 2 in a first perspective view.
Figure 12:
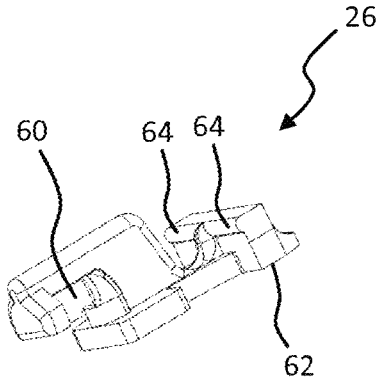
FIG. 12 shows the locking lever of FIG. 11 in a second perspective view.
Figure 13:
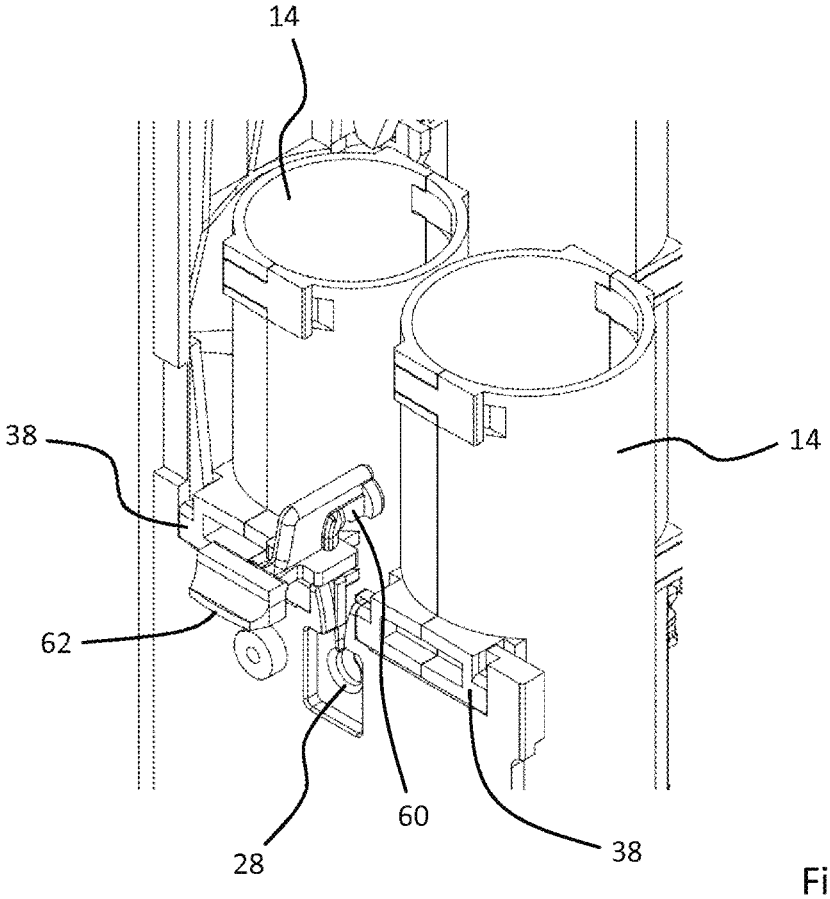
FIG. 13 shows a further enlarged detail of the coin storage unit shown in FIG. 2 in a pre-installation position of the locking lever.
Figure 14:
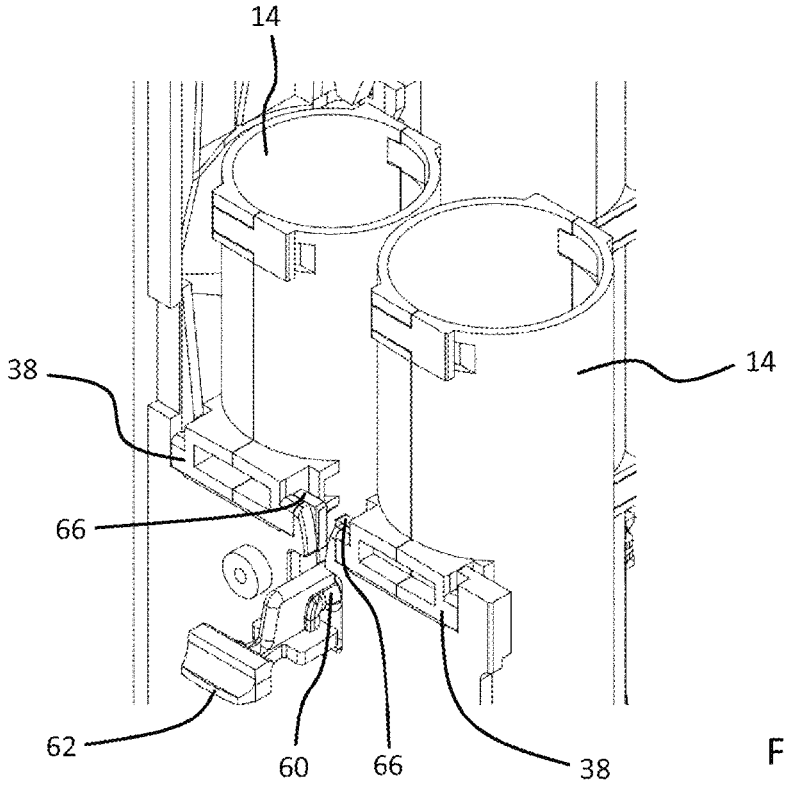
FIG. 14 shows the detail of FIG. 13 with locking lever in its unlocking position.
Figure 15:
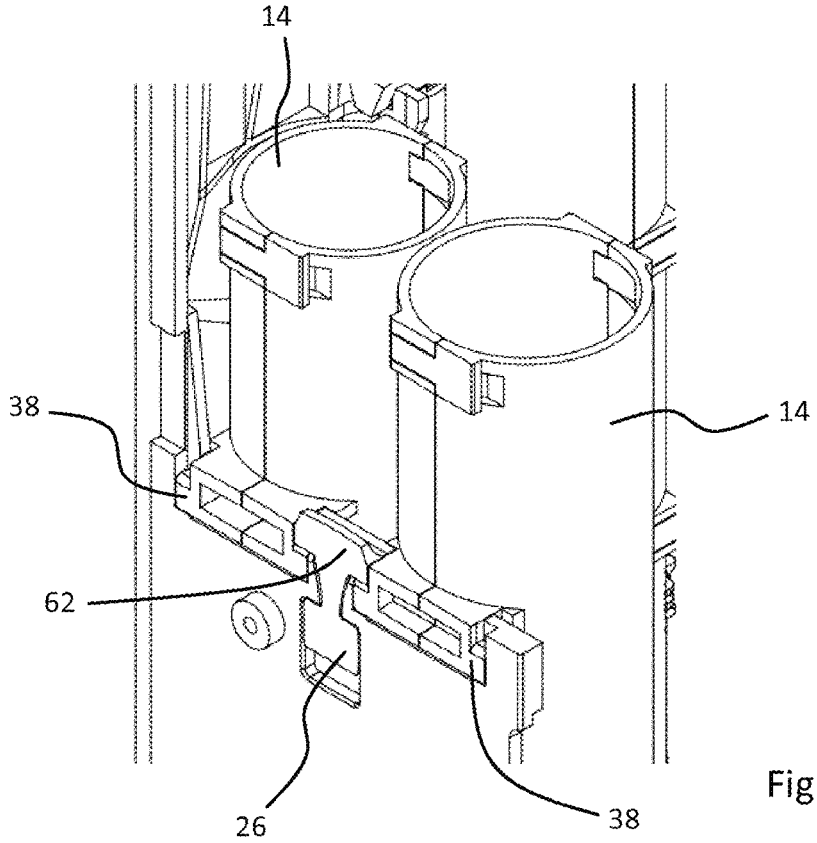
FIG. 15 shows the detail of FIG. 13 with locking lever in its locking position.

FIGS. 11 and 12 show one of the locking levers 26 shown in FIG. 4 in an enlarged view. The locking lever 26 has a mounting section 60 and a locking section 62 which is T-shaped in the example shown. Latching surfaces 64 are provided on the locking section 62. As shown in FIG. 13, the locking lever 26 is installed from above into the keyhole-shaped lever receptacle 28, with the mounting section 60 being press-fitted into the unlocking position shown in FIG. 14. In this position, the locking lever 26 is accommodated captively latched in the lever receptacle 28 and is pivotably mounted between the unlocking position shown in FIG. 14 and the locking position shown in FIG. 15. In the unlocking position shown in FIG. 14, the coin tubes 14 can be withdrawn axially upward out of the housing 18 or inserted axially downward into the housing 18. If the adjacent coin tubes 14 have reached their fully inserted position in the housing 18, the locking lever 26 can be pivoted by 90° from the unlocking position shown in FIG. 14 into the locking position shown in FIG. 15. Latching surfaces 66 corresponding to the latching surfaces 64 of the locking levers can be provided on the frame section 20 of the housing 18. In the locking position, the latching surfaces 64 of the locking lever 26 latch with the associated latching surfaces 66 of the frame section 20. In the locking position shown in FIG. 15, the coin tubes 14 are thus secured by the locking lever 26 and the locking surfaces 58 against axial withdrawal from the housing 18. It is additionally apparent that the locking lever 26 terminates flush with the outer surface of the housing surrounding it in the locking position. It is only surface flush in the locking position. It is to be noted that the function of the locking described for one locking lever 26 and an adjacent pair of coin tubes is identical for all pairs of coin tubes of the coin storage unit.

Due to the design of the locking lever 26 and the locking function, on the one hand, reliable and visually and haptically simple to check locking of the coin tubes 14 in the housing 18 is implemented. On the other hand, in the example shown, an installation of the front cover 24 and an installation of the coin storage unit in the main housing 10 of the money changer is only possible when the locking lever 26 is in the locking position and thus when the coin tubes 14 are properly inserted. In addition, by using the space between two adjacent coin tubes 14 for locking, an arrangement of coin tubes 14 having a particularly large diameter is also enabled, the outer surface of which essentially directly abuts the respective inner surface of the housing 18 or an adjacent coin tube 14. Due to the symmetrical arrangement of the locking and design of the coin tubes 14, the coin tubes 14 can be exchanged with one another in a simple manner.

LIST OF REFERENCE SIGNS

10 main housing
12 coin slot
14 coin tubes
16 coin storage unit
18 housing
20 frame section
22 base section
24 front cover
26 locking lever
28 lever receptacle
30 housing surface
32 outer walls
34 inner sides
36 handle
38 upper guide projections
40 lower guide projections
42 tube-side guide grooves
44 tube-side guide webs
46 upper housing-side guide webs
48 lower housing-side guide webs
50 insertion bevels
52 centering pins
54 support surfaces
56 connecting section
58 locking surfaces
60 assembly section
62 locking section
64 latching surfaces of the locking lever
66 latching surfaces of the frame section

The invention claimed is:

1. A coin storage unit comprising:

a housing;

coin tubes arranged independently interchangeable in the housing, wherein the coin tubes are removable from the housing in an axial direction; and locking means which are actuatable between a locking position locking the coin tubes against removal from the housing and an unlocking position releasing the coin tubes for removal from the housing, wherein the locking means are each arranged between two adjacent coin tubes in the housing and lock the adjacent coin tubes against removal from the housing in the locking position, and wherein the locking means only assume the locking position in a state of the adjacent coin tubes inserted completely into the housing, wherein the locking means comprise at least one locking lever that is pivotable on the housing between the locking position and the unlocking position, and wherein the coin tubes each comprise at least one locking projection on their outer circumference, and the at least one locking lever rests in the locking position on locking projections of adjacent coin tubes.

2. The coin storage unit of claim 1, wherein the locking means are provided on the housing.

3. The coin storage unit of claim 1, wherein the locking means are each arranged and formed symmetrically with respect to adjacent coin tubes.

4. The coin storage unit of claim 1, wherein the at least one locking lever latches in the locking position on latching surfaces of the housing.

5. The coin storage unit of claim 1, wherein the at least one locking lever is pivotably mounted on the housing by means of a latching connection.

6. The coin storage unit of claim 1, wherein the at least one locking lever only terminates flush with a surface of the housing surrounding the at least one locking lever in the locking position.

7. The coin storage unit of claim 1, further comprising guide means for guiding the coin tubes in a radial direction.

8. The coin storage unit of claim 7, wherein the guide means comprise guide projections on the coin tubes and guide webs on the housing corresponding to the guide projections.

9. The coin storage unit of claim 8, wherein the coin tubes each have an upper guide projection in an upper region of each of the coin tubes and a lower guide projection in a lower region of each of the coin tubes, and wherein corresponding upper and lower guide webs are formed on the housing.

10. The coin storage unit of claim 9, wherein the upper guide projection forms the locking projection.

11. The coin storage unit of claim 9 wherein at least the lower guide webs have insertion bevels for the lower guide projection.

12. The coin storage unit of claim 9, wherein the guide means further comprises centering pins and centering receptacles formed on a lower side of the coin tubes and on an associated bottom side of the housing, wherein the centering pins and the centering receptacles interlock in the state of the coin tubes completely inserted into the housing.

13. The coin storage unit of claim 8, wherein a radial distance between the guide projections and a tube center axis is the same for each of the coin tubes.

14. The coin storage unit of claim 8, wherein the coin tubes have different internal diameters in a range from 17 mm to 33 mm, and wherein the coin tubes are operable to be arranged at different positions in the housing.

15. The coin storage unit of claim 14, wherein a radial distance between the guide projections and a tube center axis is the same for each of the coin tubes.

16. The coin storage unit of claim 7, wherein the guide means further comprises centering pins and centering receptacles formed on a lower side of the coin tubes and on an associated bottom side of the housing, wherein the centering pins and the centering receptacles interlock in the state of the coin tubes completely inserted into the housing.

17. The coin storage unit of claim 1, wherein the coin tubes have different internal diameters in a range from 17 mm to 33 mm, and wherein the coin tubes are operable to be arranged at different positions in the housing.

18. The coin storage unit of claim 1, wherein the coin storage unit is inserted into a main housing of a money changer.

* * * * *